US010256034B2

(12) United States Patent
Miki et al.

(10) Patent No.: US 10,256,034 B2
(45) Date of Patent: Apr. 9, 2019

(54) CORE CASE UNIT, COIL COMPONENT, AND METHOD FOR PRODUCING COIL COMPONENT

(71) Applicant: HITACHI METALS, LTD., Minato-ku, Tokyo (JP)

(72) Inventors: Hirohiko Miki, Osaka (JP); Takayuki Morikawa, Osaka (JP); Masatoshi Akita, Tottori (JP); Masahiro Morita, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 148 days.

(21) Appl. No.: 15/309,664

(22) PCT Filed: May 8, 2015

(86) PCT No.: PCT/JP2015/063358
§ 371 (c)(1),
(2) Date: Nov. 8, 2016

(87) PCT Pub. No.: WO2015/170756
PCT Pub. Date: Nov. 12, 2015

(65) Prior Publication Data

US 2017/0154723 A1 Jun. 1, 2017

(30) Foreign Application Priority Data

May 9, 2014 (JP) ..... 2014-097798

(51) Int. Cl.
*H01F 27/32* (2006.01)
*H01F 5/02* (2006.01)
(Continued)

(52) U.S. Cl.
CPC ..... *H01F 27/325* (2013.01); *H01F 5/02* (2013.01); *H01F 17/06* (2013.01); *H01F 27/02* (2013.01);
(Continued)

(58) Field of Classification Search
CPC .... H01F 27/325; H01F 27/02; H01F 27/2823; H01F 5/02; H01F 17/06; H01F 41/10; H01F 41/08; H01F 41/06
(Continued)

(56) References Cited

U.S. PATENT DOCUMENTS 4,701,735 A * 10/1987 Hill ..... H01F 5/00 335/282
5,208,573 A * 5/1993 Nagaoka ..... H01F 5/02 336/192
(Continued)

FOREIGN PATENT DOCUMENTS

JP 58-012426 3/1983
JP 62-036270 9/1987
(Continued)

OTHER PUBLICATIONS

International Search Report for PCT/JP2015/063358 dated Jul. 21, 2015.

*Primary Examiner* — Mang Tin Bik Lian
(74) *Attorney, Agent, or Firm* — Nixon Peabody LLP; Jeffrey L. Costellia

(57) ABSTRACT

A core case unit (100) includes: an annular case (1) which houses a magnetic core (4); and a bobbin (2) around which a wire is to be wound, wherein the bobbin (2) includes a cylindrical portion (5) around which the wire is to be wound, inner flanges (6) provided at opposite ends of the cylindrical portion, outer flanges (7) provided on an outer side of the inner flanges with a space being left which is capable of
(Continued)

containing a wire end portion, and a gear portion (8) provided on an outer side of at least one of the outer flanges for receiving rotational force, the bobbin being rotatably supported on the case at the cylindrical portion, an outside diameter of the outer flanges (7) is greater than an outside diameter of the gear portion which is defined by an addendum circle, and the inner flanges (6) and the outer flanges (7) have a recessed portion (15, 16) through which a wire end portion is to be passed.

13 Claims, 10 Drawing Sheets

(51) Int. Cl.

| | |
|---|---|
| ***H01F 17/06*** | (2006.01) |
| ***H01F 41/06*** | (2016.01) |
| ***H01F 41/08*** | (2006.01) |
| ***H01F 41/10*** | (2006.01) |
| ***H01F 27/02*** | (2006.01) |
| ***H01F 27/28*** | (2006.01) |

(52) U.S. Cl.
CPC ..... *H01F 27/2823* (2013.01); *H01F 41/06* (2013.01); *H01F 41/08* (2013.01); *H01F 41/10* (2013.01)

(58) Field of Classification Search
USPC ..... 336/219, 198, 208, 229, 221, 220
See application file for complete search history.

(56) References Cited

U.S. PATENT DOCUMENTS

| | | | | |
|---|---|---|---|---|
| 5,793,273 | A * | 8/1998 | Yamaguchi | H01F 17/04 333/181 |
| 6,937,129 | B2 * | 8/2005 | Hsueh | H01F 27/2823 336/198 |
| 7,474,187 | B1 | 1/2009 | Huang et al. | |
| 8,242,871 | B2 * | 8/2012 | Kobayashi | H01F 27/2828 29/602.1 |
| 2012/0286918 | A1 * | 11/2012 | Lai | H01F 3/12 336/212 |
| 2013/0154782 | A1 * | 6/2013 | Won | H01F 5/02 336/192 |

FOREIGN PATENT DOCUMENTS

| | | |
|---|---|---|
| JP | H06-325958 | 11/1994 |
| JP | 2015-002316 | 1/2015 |

* cited by examiner

CORE CASE UNIT, COIL COMPONENT, AND METHOD FOR PRODUCING COIL COMPONENT

TECHNICAL FIELD

The present invention relates to a coil part such as a transformer, a core case unit for use in the coil part, and a manufacturing method of the coil part.

BACKGROUND ART

A power supply device, such as a switched mode power supply or insulated inverter whose output exceeds 1 kW, is driven at about 10 kHz to 80 kHz from the viewpoint of efficiency. A typical example of the magnetic core material of a transformer for use in a switched mode power supply or the like which is driven in such a condition is a Mn—Zn ferrite. From the viewpoint of size reduction, a soft magnetic alloy material, such as an amorphous material or nanocrystalline material whose saturation magnetic flux density is high, can also be used. In a common configuration of the transformer, magnetic cores molded in a "UU" or "FE" shape are joined together in a coil form formed by winding a wire (conductive wire) around a bobbin beforehand, so as to form a magnetic path in a "口" shape, racetrack shape, or "日" shape.

In the above configuration, a gap occurs at the joint surfaces even though it is very small. Particularly when using a cut core formed from a soft magnetic alloy ribbon whose specific resistance is low, such a gap occurs so that a loss resulting from magnetic flux leakage increases. Thus, when the soft magnetic alloy ribbon is used in the form of a cut core, the operation magnetic flux density cannot be sufficiently increased, and it is difficult to say that a design which fully exploits the properties of the soft magnetic alloy material is possible.

Meanwhile, there is a transformer which uses an uncut core, such as a toroidal transformer. Here, an uncut core is sometimes referred to as "no-cut core" in comparison to "cut core". However, winding of a wire in the toroidal transformer is manually carried out, and therefore, a problem of poor manipulation convenience arises. Further, it is difficult to make the state of the wound wire uniform, so that a problem of large property variations, etc., arises due to the effect of parasitic capacitance caused by the nonuniformly-wound wire. Patent Document 1 discloses, for example, the technique of efficiently winding a wire around an uncut magnetic core. Specifically, Patent Document 1 proposes a structure which is capable of mechanical winding by rotating a bobbin with the use of a driver. A reel (bobbin) disclosed in Patent Document 1 is shown in FIG. 18. In this bobbin, the circumferences of flanges 315 at opposite ends of a barrel 312 around which a coil is to be provided have teeth which are configured to mesh with driver teeth. The inner lateral surface of the flange 315 has a groove 318 in which an end portion of the wire at the start of winding is to be inserted and engaged for securing the wire to the flange 315. The groove 318 is provided for the purpose of preventing the starting end portion of the wire that is to form the coil from hindering rotation of the bobbin.

Patent Document 2 discloses a bobbin which has a different configuration. FIG. 19 shows an external view of the bobbin. This bobbin has restriction walls 415 which are provided on the inner side of flanges 414 that are provided at opposite ends of a barrel 425 and which have a smaller diameter than the flanges 414. The spaces between the flanges 414 and the restriction walls 415 are used as grooves 427 around which coil end portions are to be wound. An end portion of a coil (not shown) that is to be provided around the barrel 425 is wound around the groove 427. A wire which is to form the coil is passed to the barrel 425 through an insertion groove (not shown) provided in the restriction walls 415. Rotational force is applied to the flanges 414 such that a coil is evenly formed around the barrel 425. The flange 414 has a nail (not shown) on the groove 427 side such that the end portion of the coil would not be forced out of the groove 427.

CITATION LIST

Patent Literature

Patent Document 1: Japanese Utility Model Publication for Opposition No. 62-36270

Patent Document 2: Japanese Utility Model Publication for Opposition No. 58-12426

SUMMARY OF INVENTION

Technical Problem

However, even when the bobbin disclosed in Patent Document 1 or Patent Document 2 is used, it is difficult to tightly secure an end portion of a wire at the start of winding to the groove 318 or the groove 427. At the start of mechanical wire winding, a large tension is likely to occur at an end portion of a wire that forms a coil, so that the end portion of the wire can be forced out of the groove or the wound wire can loosen in some cases. In rotating the bobbin for formation of the coil, if the end portion of the wire is forced out of the groove or the wound wire loosens, the end portion of the wire is bitten between the flange and the driver teeth, or entangled in a wound portion (coil portion) of the wire, so that a normal wire winding operation can be interrupted. Such a problem is more frequent as a plurality of coils are formed in multiple layers so that there are a plurality of end portions of wires that form the respective coils or as the length of the end portion of the wire at the start of winding increases. In the bobbin of Patent Document 2, the flange 414 has a nail for restricting movement of the coil end portion. However, the nail is near the circumferential surface of the flange 414 to which the rotational force is to be applied, so that there is still a probability that the coil end portion is bitten between the flange and the driver teeth. The finishing side of winding also has the same reasons. Hereinafter, an end portion of a wire which forms a coil is referred to as "wire end portion".

When a plurality of coils are formed around a bobbin to obtain a transformer, it is necessary to secure insulation between the primary coil and the secondary coil as for the process of drawing out the wire end portion from the bobbin. Further, in a coil part, such as a power transformer exceeding 1 kW, heat produced due to conductor loss is large, and therefore, it is necessary to release the heat such that thermal damage to the coil and the coil reel is prevented. However, these points are not considered in Patent Document 1 or Patent Document 2.

Thus, in view of the problems discussed above, an object of the present invention is to provide a configuration suitable for preventing entanglement of a wire end portion in a gear or coil portion in a core case unit which includes a bobbin applicable to mechanical winding that is realized by gear driving, in a coil part which includes the core case unit, and in a manufacturing method of the coil part.

Solution to Problem

A core case unit according to an embodiment of the present invention includes: an annular case which houses a magnetic core; and a bobbin around which a wire is to be wound, wherein the bobbin includes a cylindrical portion around which the wire is to be wound, inner flanges provided at opposite ends of the cylindrical portion, outer flanges provided on an outer side of the inner flanges with a space being left between the outer flanges and the inner flanges which is capable of containing a wire end portion, and a gear portion provided on an outer side of at least one of the outer flanges for receiving rotational force, the bobbin being rotatably supported on the case at the cylindrical portion, an outside diameter of the outer flanges is greater than an outside diameter of the gear portion which is defined by an addendum circle, and the inner flanges and the outer flanges have a recessed portion through which a wire end portion is to be passed.

In one embodiment, it is preferred that, when viewed in an axial direction of the cylindrical portion, the recessed portion of the inner flange and the recessed portion of the outer flange at least partially overlap.

In one embodiment, it is preferred that the inner flange and the outer flange each have a pair of recessed portions, and when viewed in an axial direction of the cylindrical portion, the pair of recessed portions of the inner flange are at positions of rotational symmetry of 180°, and the pair of recessed portions of the outer flange are also at positions of rotational symmetry of 180°.

In one embodiment, it is preferred that the space which is capable of containing the wire end portion is a groove running around the cylindrical portion in a circumferential direction of the cylindrical portion, and it is also preferred that a distance in a radial direction from a center of the cylindrical portion to a bottom surface of the groove is substantially equal to a distance in the radial direction from the center of the cylindrical portion to a lateral surface of the cylindrical portion.

In one embodiment, it is preferred that, in the core case unit, a protrusion is provided for supportedly holding the wire end portion, the protrusion protruding outward in an axial direction of the cylindrical portion from a surface of the inner flange.

In one embodiment, it is preferred that an outside diameter of the inner flange is greater than an outside diameter of the outer flange, and a protruding position of the protrusion is outside an outer perimeter of the outer flange when viewed in an axial direction of the cylindrical portion.

In one embodiment, it is preferred that when viewed in an axial direction of the cylindrical portion, the protrusions are at positions of rotational symmetry of 180°.

In one embodiment, it is preferred that a bottom of a recessed portion of the inner flange is substantially equally distant from a lateral surface of the cylindrical portion and from a center axis of the cylindrical portion, and a bottom of a recessed portion of the outer flange is substantially equally distant from a circumferential surface of an addendum circle of the gear portion and from the center axis of the cylindrical portion.

A coil part according to an embodiment of the present invention includes: any of the above-described core case unit; a no-cut magnetic core of a closed magnetic path housed in the case; and a coil formed by winding a wire around the bobbin, wherein the coil is provided between inner flanges that are provided at opposite ends of the cylindrical portion.

A coil part according to an embodiment of the present invention includes: the core case unit which has a recessed portion; a no-cut magnetic core of a closed magnetic path housed in the case; and a coil formed by winding a wire around the bobbin, wherein the coil is provided between inner flanges that are provided at opposite ends of the cylindrical portion, and a wire end portion of the wire that forms the coil is guided out to an outside of an outer flange through a recessed portion of the inner flange and a recessed portion of the outer flange.

In one embodiment, it is preferred that, in the coil part, the coil includes a primary coil and a secondary coil which are constituents of a transformer, and a wound portion of a wire that forms the primary coil and a wound portion of a wire that forms the secondary coil are arranged alternately in multiple layers in a radial direction of the cylindrical portion.

In one embodiment, it is preferred that, in the coil part, each of the inner flange and the outer flange has two recessed portions, and a wire end portion of the wire that forms the primary coil is guided out through one of two recessed portions provided in each of the inner flange and the outer flange, and a wire end portion of the wire that forms the secondary coil is guided out through the other one of the two recessed portions provided in each of the inner flange and the outer flange.

A manufacturing method of a coil part according to an embodiment of the present invention includes: the first step of housing a no-cut magnetic core of a closed magnetic path in a case; the second step of rotatably attaching a bobbin to the case, the bobbin including a cylindrical portion around which a wire is to be wound, inner flanges provided on opposite ends of the cylindrical portion, and outer flanges provided on an outer side of the inner flanges; and the third step of winding a wire around the cylindrical portion, thereby forming a coil, wherein the bobbin further includes a gear portion provided on an outer side of at least one of the outer flanges for receiving rotational force, and an outside diameter of the outer flanges is greater than an outside diameter of the gear portion which is defined by an addendum circle, the third step includes rotating the bobbin via the gear portion, thereby winding the wire around the cylindrical portion to form a coil, and the third step is repeated while a wire end portion is placed in a space between the inner flanges and the outer flanges, thereby forming a plurality of coils outside the cylindrical portion.

In one embodiment, it is preferred that the coil includes a primary coil and a secondary coil which are constituents of a transformer, and a wound portion of a wire that forms the primary coil and a wound portion of a wire that forms the secondary coil are arranged alternately in multiple layers in a radial direction of the cylindrical portion.

Further, in one embodiment, it is preferred that a protrusion is provided for supportedly holding the wire end portion, the protrusion protruding outward in an axial direction of the cylindrical portion from a surface of the inner flange, and in the third step, the wire end portion is supportedly held by the protrusion such that movement of the wire end portion toward an outer side of the outer flange is restricted.

In one embodiment, it is preferred that each of the inner flange and the outer flange has a recessed portion, and the method further comprises, after the third step, guiding out the wire end portion to an outside of the outer flange through the recessed portion of the inner flange and the recessed portion of the outer flange.

In one embodiment, it is preferred that each of the inner flange and the outer flange has two recessed portions, and the method further comprises, after the third step, guiding out a plurality of wire end portions of a wire that form the primary coil and a plurality of wire end portions of a wire that form the secondary coil through different recessed portions.

Advantageous Effects of Invention

According to an embodiment of the present invention, a configuration suitable for preventing entanglement of a wire end portion in a gear or coil portion is provided in a core case unit which includes a bobbin applicable to winding that is realized by gear driving, in a coil part which includes the core case unit, and in a manufacturing method of the coil part. Using such a configuration improves the manipulation convenience in a wire winding operation. When applied to a coil part which includes a plurality of coils around a bobbin, the configuration facilitates to draw out end portions of the respective coils with the end portions being separate from one another.

DESCRIPTION OF EMBODIMENTS

A configuration of a core case unit according to an embodiment of the present invention is described below.

The core case unit according to an embodiment of the present invention includes an annular case which houses a magnetic core and a bobbin around which a wire is to be wound. The case typically has a linear portion extending along the magnetic path of the magnetic core. The bobbin includes a cylindrical portion around which the wire is to be wound, inner flanges provided at opposite ends of the cylindrical portion, outer flanges provided on the outer side of the inner flanges, and a gear portion provided on the outer side of at least one of the outer flanges for receiving rotational force. The bobbin is rotatably supported on the case at the cylindrical portion. Such a configuration enables mechanical winding by means of rotation via the gear portion (hereinafter, also referred to as "gear winding"). Thus, in a case where an annular case housing a magnetic core is used, the manipulation convenience in a wire winding operation can be secured. Further, the spaces between the inner flanges and the outer flanges can be used for containing wire end portions in the wire winding operation. Furthermore, in the wire winding operation, wire end portions of a plurality of coils can be kept in those spaces.

The outside diameter of the outer flange is greater than the outermost diameter of the gear portion. In such a configuration, even when flinging, fluttering or disorder of the wire end portion occurs in winding of the wire, the wire end portion that is to be contained in the space between the inner flange and the outer flange can be more surely prevented from being bitten in the gear portion.

Hereinafter, embodiments of a core case unit, a coil part which includes the core case unit, and a manufacturing method of the coil part according to the present invention are described more specifically with reference to the drawings, although the present invention is not limited to these embodiments. Configurations which will be described in respective embodiments can be applied to other embodiments so long as they do not mar the concepts of the other embodiments. In such a case, repetitive description will be appropriately omitted. In the following description, a component which is designated in a referred drawing by only a numeral with an alphabetic suffix can be mentioned only by the representative numeral, without the alphabetic suffix, particularly when distinguishment by the alphabetic suffix is not necessary.

Figure 1:
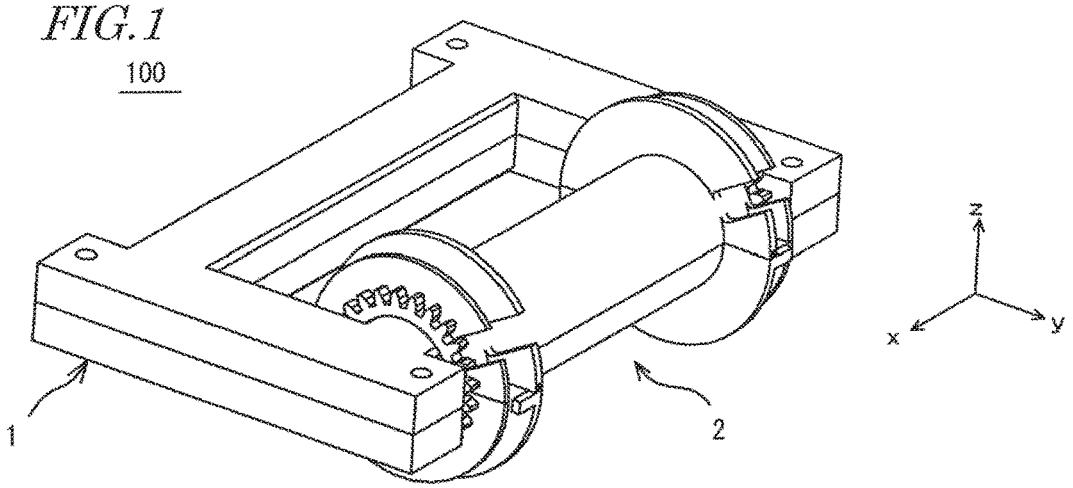
FIG. 1 is a perspective view showing an embodiment of a core case unit of the present invention.
Figure 2:
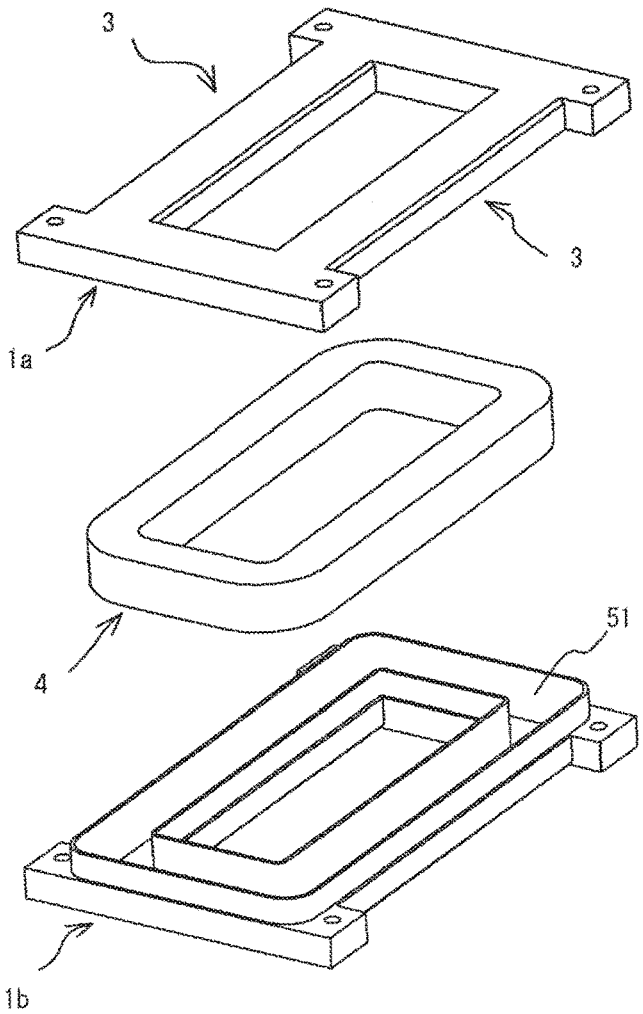
FIG. 2 is an exploded perspective view of a case for use in the embodiment of the core case unit of the present invention.
Figure 3:
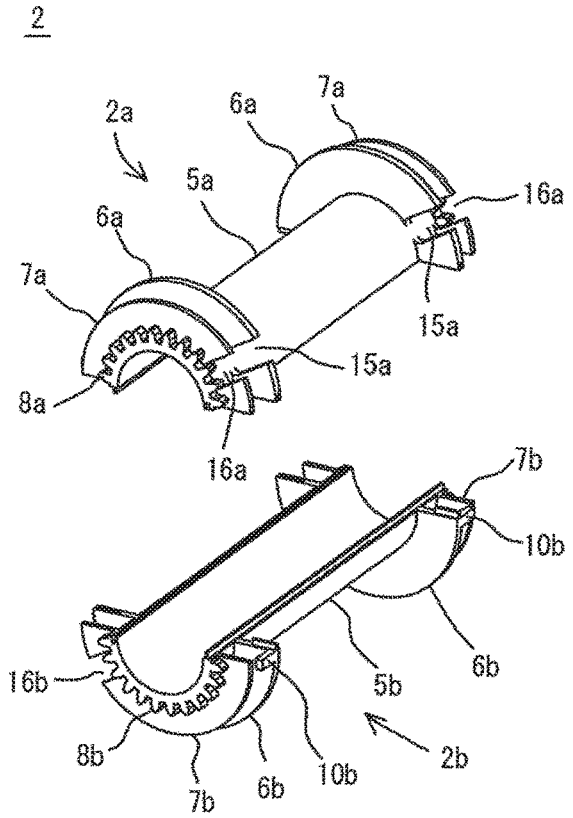
FIG. 3 is an exploded perspective view of a bobbin for use in the embodiment of the core case unit of the present invention.

FIG. 1 is a perspective view showing an embodiment of a core case unit of the present invention. FIG. 2 is an exploded perspective view of a case for use in the embodiment shown in FIG. 1. FIG. 3 is an exploded perspective view of a bobbin. In the following description, we assume that a coil part to which the core case unit is applied is a transformer, although uses of the core case unit are not limited to the transformer. The core case unit 100 includes an annular case 1 for housing a magnetic core 4 and a bobbin 2 around which a wire is to be wound. Although the configuration of the magnetic core 4 housed in the annular case 1 is not particularly limited, the magnetic core 4 can be, for example, a no-cut core which is formed by a magnetic alloy ribbon. Here, "no-cut" means that the magnetic alloy ribbon has no disconnected portion in the middle of its magnetic path. The no-cut magnetic core of a closed magnetic path does not have a magnetic gap, and therefore, the effect of magnetic flux leakage is avoided, and driving of the transformer with a high operation magnetic flux density is possible. Details of the configuration of the magnetic core will be described later.

(Case)

The case (protector member) 1 is an assembly consisting of an upper case 1*a* and a lower case 1*b*, which are separated vertically (z direction in the drawing). Note that the concept of the term "vertical" used herein is merely for the sake of convenience in directional expressions in assemblage. The lower case 1*b* has a space 51 for housing the magnetic core 4. The upper case 1*a* and the lower case 1*b* fit with each other such that the space is covered with the upper case 1*a*. In the embodiment shown in FIG. 1, the joint portion (meeting portion) between the upper case 1*a* and the lower case 1*b* is present at lateral surfaces of the annular case 1 (surfaces of the annular case 1 which are parallel to the z axis shown in FIG. 1). The case 1 includes a pair of linear portions 3 extending along the magnetic path of the magnetic core 4 (along the x direction in the drawing). The case 1 is a rectangular annular case which is configured so as to accord with the shape of the magnetic core 4 and also has linear portions extending in the y direction in the drawing. Note that, at the four corners of the case 1, the case 1 has portions protruding in the y direction, which serve as securing portions for fastening together the upper case 1*a* and the lower case 1*b*. Also when the case has such protruding portions or rounded portions (curved portions) at the corners, the general shape of the case is considered as a rectangular shape. The insulation distance (space distance or creepage distance) between the magnetic core 4 and the coil is secured by the case 1.

When the magnetic core is made of a magnetic alloy ribbon, a cross section of the magnetic core perpendicular to the magnetic path usually has a rectangular shape irrespective of whether the magnetic core is in the form of a wound magnetic core or a multilayer magnetic core. Accordingly, the internal shape in a cross section of the case that is designed to house the magnetic core is usually rectangular. Although the external shape in the cross section of the case can have a non-rectangular shape, it is preferably rectangular from the viewpoint of simplification of the case structure.

Although the external shape in a cross section of a linear portion of the case 1 which supports the cylindrical portion of the bobbin 2 can have a circular shape or a polygonal shape which has n angles (n is a natural number not less than 5), using a case which has a rectangular cross section provides the following advantages. For example, in the case where a transformer is constructed using a core case unit, the magnetic core produces heat when the transformer is driven. Radiation of the heat from a portion covered with the coil is hindered by the coil, so that the temperature of the transformer increases. On the other hand, when the external shape in a cross section of a case used is rectangular, a large space communicating with the outside of the bobbin is formed between the outer surface of the case and the inner surface of the bobbin, so that heat radiation can be enhanced, and increase in temperature of the transformer can be suppressed.

In the embodiment shown in FIG. 1, a cross section of the magnetic core 4 which is perpendicular to the magnetic path direction has an oblong quadrangular shape. The magnetic core 4 is housed in the case 1 such that the long side of the oblong quadrangular cross section of the magnetic core 4 is on the joint portion side between the upper case 1*a* and the lower case 1*b*, i.e., on the inner perimeter side and the outer perimeter side of the annular case. In order to shorten the whole length of the wire wound around the bobbin, the cross-sectional shape of the case that is provided inside the cylindrical portion of the bobbin is preferably as close to square as possible. However, when the thickness of the case is decreased for size reduction, the thickness of the case is relatively large in the joint portion between the upper case 1*a* and the lower case 1*b* as compared with the other portions. On the other hand, a magnetic core which has an oblong quadrangular cross section is prepared and is arranged such that its long side is on the joint portion side (lateral surface side), whereby the above-described increase in thickness of the case can be offset by the difference in dimension between the long side and the short side of the magnetic core. With such a configuration provided, it is preferred that, in the external shape of the case 1, the shape of a cross section which is perpendicular to the magnetic path direction of the magnetic core 4 is closer to square than the shape of the cross section of the magnetic core 4 (the ratio between the short side and the long side is close to 1) or square. Among these options, square is most preferred. In the configuration of FIG. 1, the cross-sectional shape of the case 1 is square. Note that, however, a cross section of the magnetic core 4 which is perpendicular to the magnetic path direction may have a generally square shape. Also in this case, the external shape of a cross section of the case 1 is likewise generally square as is the magnetic core 4 so long as the thickness of the case 1 is sufficiently small.

The case 1 is used for the purposes of, for example, protecting the magnetic core 4 and securing insulation. So long as such purposes are accomplished, the material of the case is not particularly limited. For example, a resin such as polyethylene terephthalate (PET), polybutylene terephthalate (PBT), polyphenylene sulfide (PPS), or the like, can be used.

In the above-described configuration, the case 1 which serves as a protector member is formed by assembling a plurality of members (the upper case 1*a* and the lower case 1*b*), although the present invention is not limited to this example. For example, the case used may be formed by an opening-type integral member that has a housing space which conforms to the magnetic core. In this case, after the magnetic core is housed in the case, the magnetic core is secured to the case using an insulative tape or the like such that the magnetic core would not fall out of the case, while insulation between the magnetic core 4 and the coil is secured. In the above-described configuration, the case 1 used is configured to have a space which is capable of housing the entirety of the magnetic core 4, although the present invention is not limited to this example. The protector member may be configured to cover only a portion of the magnetic core. Note that, however, the protector member is preferably arranged so as to cover at least part of the magnetic core 4 to which the bobbin 2 is to be attached. Due to this arrangement, as will be described later, when the bobbin 2 is rotated around the magnetic core 4, the probability of damaging the magnetic core can be reduced by the protector member. When the strength is insufficient only with the protector member, the strength of the magnetic core itself can be improved by performing resin impregnation on the magnetic core 4.

(Bobbin)

The bobbin 2 includes a cylindrical portion 5 around which a wire is to be wound for formation of a coil, inner flanges 6 provided at opposite ends of the cylindrical portion 5, outer flanges 7 provided on the outer side of the inner flanges 6, and a gear portion 8 provided on the outer side of the outer flanges 7. The gear portion 8 is configured to be meshable with a gear of an unshown driver device. As will be described later, by rotating the gear of the driver device, the bobbin 2 can be rotated around the linear portion of the case 1 via the gear portion 8.

The bobbin 2 is also formed as an assembly of two separate portions 2*a*, 2*b*. The two separate portions 2*a*, 2*b* are assembled into the bobbin 2 so as to bind the case 1. The inner flanges 6 (6*a*, 6*b*) have the shape of a circular plate whose outside diameter is greater than the outside diameter of the cylindrical portion 5 (5*a*, 5*b*), and define a winding portion for a wire. That is, a wire for formation of a coil is wound around part of the perimeter surface of the cylindrical portion 5 between a pair of inner flanges 6 that are arranged with a gap therebetween. The bobbin 2 includes, on the outer side of the inner flanges 6 (6*a*, 6*b*) (on the opposite side to the winding portion for the wire when viewed in the x direction shown in FIG. 1), the outer flanges 7 which are spaced away from the inner flanges 6, and the gear portion 8 for receiving rotational force.

Figure 4:
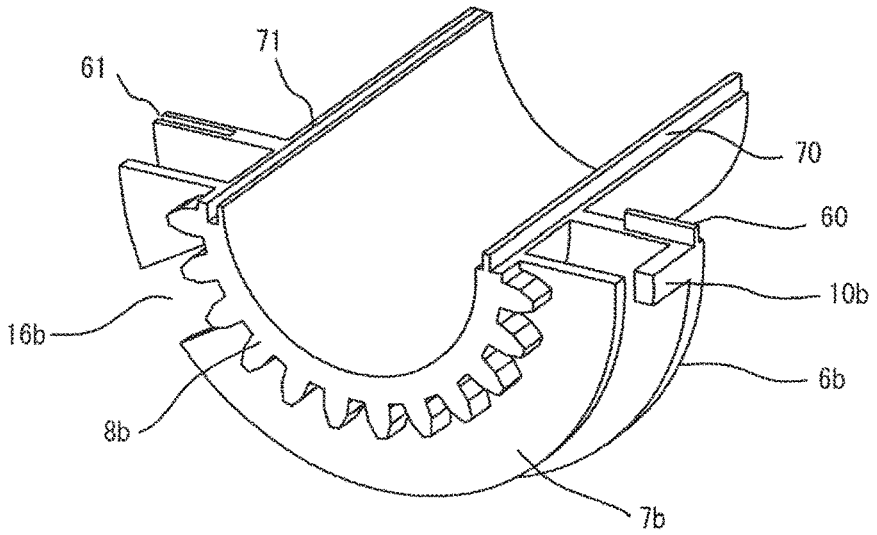
FIG. 4 is a partial enlarged view of the bobbin for use in an embodiment of the core case unit of the present invention.
Figure 5:
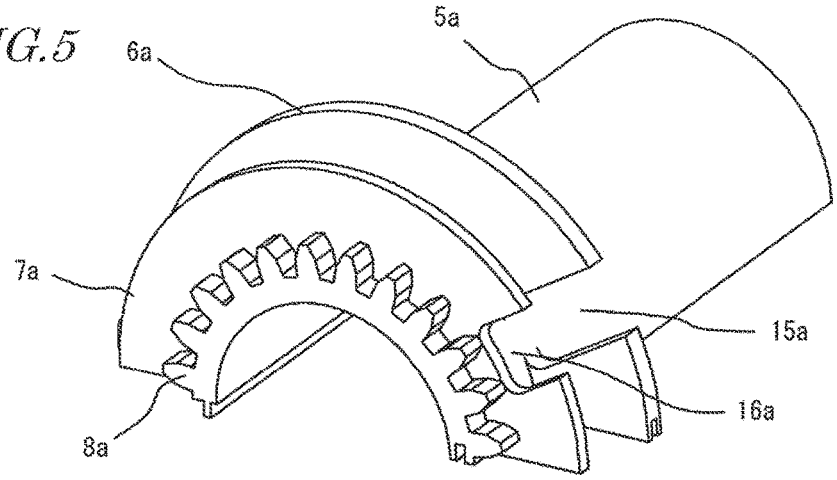
FIG. 5 is a partial enlarged view of the bobbin for use in an embodiment of the core case unit of the present invention.

FIG. 4 and FIG. 5 are partial enlarged views of the bobbin of the two-part configuration shown in FIG. 3. This bobbin which can be disassembled is a combination of two members, and can be separated into two parts along an imaginary separation line (not shown) passing through the axial center. The separation surfaces have protrusions 60, 70 and recesses 61, 71 for easy and precise assemblage and for preventing a deviation in the axial direction.

The bobbin 2 is arranged such that the inner perimeter side of the cylindrical portion 5 of the bobbin 2 is in moderate contact with the edges of the case 1 or such that there is a slight clearance between the inner perimeter side of the cylindrical portion 5 and the edges of the case 1, and the bobbin 2 is rotatably supported on a linear portion 3 of the case 1 at the cylindrical portion 5. The gear portion 8 is coaxial with the cylindrical portion 5, and the cylindrical portion 5 rotates integrally with the gear portion 8. Therefore, applying a driving force from a motor, or the like, to the gear portion 8 enables winding of a wire, so that the manipulation convenience in a wire winding operation can be secured.

Figure 6:
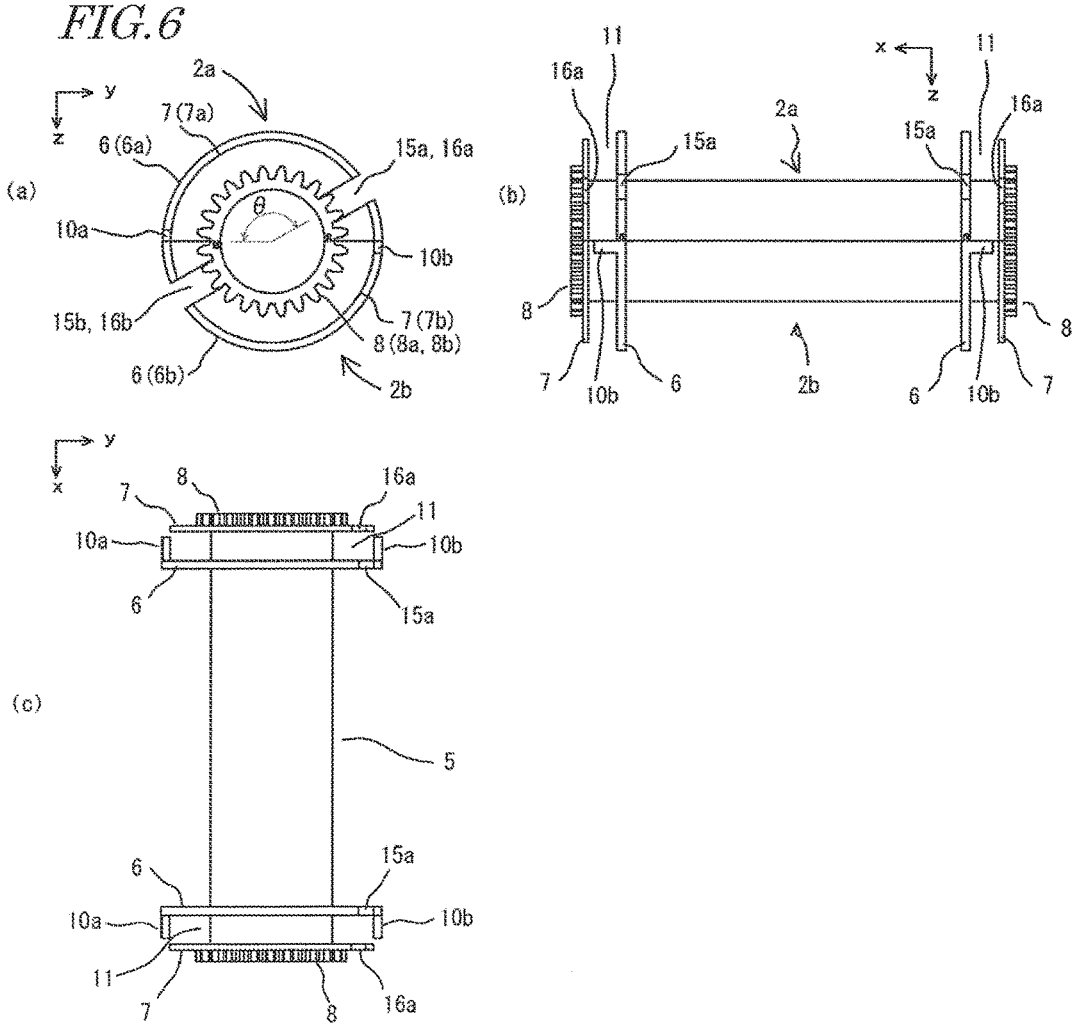
FIG. 6 is a three-side diagram showing the bobbin for use in an embodiment of the core case unit of the present invention.

The outer flanges 7 are provided between the inner flanges 6 that define a winding portion for the wire and the gear portions 8 for receiving rotational force. This aspect is one of the features of the embodiment shown in FIG. 1 and FIG. 2. This feature is now described with further reference to FIG. 6. FIGS. 6(*a*) to 6(*c*) are respectively a side view, front view, and top view of the bobbin. The outer flanges 7 also have the shape of a circular plate whose outside diameter is greater than the outside diameter of the cylindrical portion 5 as do the inner flanges 6. The inner flanges 6 and the outer flanges 7 are spaced away from each other across the entire perimeter of the cylindrical portion 5. Between the inner flanges 6 and the outer flanges 7, there are ring-shaped spaces 11 for containing wire end portions. The spaces 11 are each configured as a groove running around the cylindrical portion 5 in the circumferential direction of the cylindrical portion 5. A wire end portion can be contained in the space 11 so as to be wound around the bottom of the groove. Since the outside diameter of the outer flange 7 is greater than the outside diameter of the gear portion 8 which is defined by the addendum circle (the diameter of the addendum circle), the wire end portion is prevented from deviating to the gear portion side during gear winding. The wire end portion only needs to be contained so as to be wound within the space 11. Since the gear portion 8 is radially inside the outer perimeter of the outer flange 7 and is distant from the outer perimeter of the outer flange 7, the wire end portion can be surely confined so as not to deviate to the gear portion side, and can be prevented from being entangled in the gear portion 8, even when the length of the wire end portion is increased.

It is further preferred that the distance in the radial direction from the axial center of the cylindrical portion 5 to the bottom surface of the space (groove) 11 is substantially equal to the distance in the radial direction from the axial center of the cylindrical portion 5 to the lateral surface of the cylindrical portion 5 such that no step is formed. With such an arrangement, winding of a wire that is drawn from the space (groove) 11 to the cylindrical portion 5 can be easily started with the wire being in close contact with the bottom surface of the groove and the outer perimeter surface of the cylindrical portion, without passing over a step, via a recessed portion which will be described later. Therefore, when a coil is formed in multiple layers, occurrence of disorder in winding of the coil near the inner flange 6 can be suppressed.

In the embodiment shown in FIG. 1 to FIG. 6, the gear portion 8 (8*a*, 8*b*) is formed so as to protrude axially outward at the outer surface of the outer flange 7 (7*a*, 7*b*). That is, the outer flange 7 and the gear portion 8 are integrally formed, and therefore, there is no gap between the outer flange 7 and the gear portion 8. Although an alternative configuration can be used in which the outer flange 7 and the gear portion 8 are spaced away from each other in the axial direction of the cylindrical portion (x direction), it is preferred that the outer flange 7 and the gear portion 8 are integrally formed from the viewpoint of avoiding increase of the size of the bobbin 2.

In the embodiment shown in FIG. 1 to FIG. 6, the inner flanges 6 and the outer flanges 7, which are provided at opposite ends of the cylindrical portion 5, have recessed portions 15 (15*a*, 15*b*), 16 (16*a*, 16*b*) receding from their outer perimeters toward the center of the cylindrical portion (5*a*, 5*b*). Although the inner flanges 6 can have holes through which wire end portions of respective coils are guided out to the outer side of the inner flanges, the configuration that has the recessed portions through which the wire end portions are to be pulled out has higher manipulation convenience in the wire winding operation and is more preferred. When the recessed portions are provided, after coils are formed around the cylindrical portion 5, the wire end portions of the respective coils can be linearly pulled out in the axial direction, without being unnecessarily routed around in a radial direction of the cylindrical portion 5. From this viewpoint, it is preferred that the recessed portions 15, 16 reach the outer perimeter surface of the cylindrical portion 5 as in the embodiment shown in FIG. 1 to FIG. 6. Further, as shown in the partial enlarged view of the bobbin of FIG. 5, it is preferred from the viewpoint of improving the strength of the gear portion 8 that the recessed portion 16 of the outer flange 7 is configured such that the position of the bottom of the recessed portion 16 is outside the circumference of the addendum circle of the gear portion when viewed in the radial direction of the outer flange 7.

Although the shape of the recessed portions 15, 16 is not particularly limited, the recessed portions 15, 16 may have the shape of a slit which has a sufficient width for pulling out the wire. As a matter of course, the width of the recessed portions 15, 16 (particularly, the width of the recessed portions 16 provided in the outer flange 7) is not so large that the function of the outer flange 7, i.e., the function of confining the wire end portion so as not to deviate to the gear portion side, is not hindered.

Meanwhile, the width of the recessed portions 16 provided in the outer flange 7 may be greater than the width of the bottom land of the gear of the gear portion 8 (the length of the gap between teeth on the pitch circle of the gear). The width of the recessed portions 16 may be greater than the pitch of the gear. In the present embodiment, the outer flange 7, which is provided on the inner side of the gear portion 8 and which has a greater diameter than the gear portion 8, has the recessed portions 16 and therefore the shape and size of the recessed portions 16 can be relatively flexibly designed. Thus, after winding of a coil, the wire end portion of the coil can be easily pulled out straight in the axial direction without causing tension, so that the probability of wire damage can be reduced.

In the embodiment shown in FIG. 1 to FIG. 6, the outer flange 7 also has the recessed portions 16, through which the wire end portions can be guided out to the outer side of the outer flanges 7 after the wire winding operation is finished. Particularly, when viewed in the axial direction of the cylindrical portion 5 (x direction), the recessed portions 15 of the inner flanges 6 and the recessed portions 16 of the outer flanges 7 overlap, so that the wire end portions can be guided out to the outer side of the outer flanges 7 with the shortest distance, and the pulled-out structure of the wire end portions and the operation of processing the wire end portions can be simplified. Although the recessed portions 15 of the inner flanges 6 and the recessed portions 16 of the outer flanges 7 may partially overlap, it is more preferred that, as in the embodiment shown in FIG. 1 to FIG. 3, the recessed portions 15 of the inner flanges 6 and the recessed portions 16 of the outer flanges 7 are configured such that their widthwise ends are coincident with each other.

The recessed portions 15, 16 are provided on opposite sides with the connecting parts of the separate portions 2*a*, 2*b* interposed therebetween when viewed in the axial direction of the cylindrical portion 5 (x direction), so that the wire end portions (leads) of the coils can be pulled out through the respective recessed portions. Note that, in the embodiment shown in FIG. 1, each of the flanges 6, 7 has two recessed portions 15, 16 on each side, i.e., four recessed portions 15, 16 in total. When such a core case unit is used to construct a transformer, the positions at which the wire end portions of the coils are pulled out are separated from each other by 180° around the axis of the cylindrical portion 5, so that insulation from the coils in the wire-end processing and insulation between the wire end portions of the respective coils can be improved. In the embodiment shown in FIG. 1 to FIG. 6, the flanges on each side have a pair of recessed portions 15, 16, although two or more pairs can be provided according to the configuration of the coils. Note that, however, from the viewpoint of securing a gap between the pulled-out wire end portions of different coils, it is preferred that one flange only has a pair of recessed portions.

The bobbin preferably has a structure which is capable of supportedly holding the wire end portions of the respective coils which have been pulled out as described above such that the wire end portions would not be unbound during the gear winding operation. As to this point, in the bobbin of the embodiment shown in FIG. 1 to FIG. 6, protrusions 10 are provided for restricting the wire end portions from moving in radial directions of the inner flanges 6, the protrusions 10 protruding outward in the axial direction of the cylindrical portion 5 (x direction) from the surface of the inner flanges 6. Although details will be described later, the wire end portions pulled out from the recessed portions 15 of the inner flanges 6 are drawn through the spaces 11 between the inner flanges 6 and the outer flanges 7. So long as the wire end portions reach the protrusions 10, the wire end portions are supportedly held by the protrusions 10 so that the wire end portions can be prevented from being unbound by centrifugal force produced by rotation of the bobbin. The wire end portions may be engaged with and secured to the protrusions 10.

The height of the protrusions 10 from the surface of the inner flanges 6 is preferably set such that the wire end portions can be engaged with the protrusions 10. Alternatively, the height of the protrusions 10 can be set at least within a range where the protrusions 10 do not reach the gear portion 8, such that the protrusions 10 do not obstruct driving of the gear during the wire winding operation. Further, it is preferred that, as in the embodiment shown in FIG. 1 to FIG. 6, the outside diameter of the inner flanges 6 is greater than the outside diameter of the outer flanges 7, and the protruding positions of the protrusions 10 are outside the outer perimeter of the outer flanges 7 when viewed in the axial direction of the cylindrical portion 5. This is because the operation of placing the wire end portions in the spaces 11 becomes easier. When the wire end portions are engaged with the protrusions 10, the operation of engaging also becomes easier. Further, it is not necessary to excessively enlarge the gap between the inner flanges 6 and the outer flanges 7 for securing the manipulation convenience.

In order that the wire end portion has a sufficient length for a wire-end process, such as terminal connection after the gear winding operation, the position of the protrusion 10 is preferably closer to one of the recessed portions opposite to the other recessed portion through which a wire end portion that is to be engaged with the protrusion 10 is guided out. In the embodiment shown in FIG. 1 to FIG. 6, the recessed portions 15, 16 and the protrusions 10 are provided on the opposite sides (half part surface sides) which are separated from each other by a central angle (θ) of 130° or more in the circumferential direction of a half part of the inner flanges 6 and the outer flanges 7. Preferably, when viewed in the axial direction of the cylindrical portion, the recessed portion and the protrusion are at the positions of rotational symmetry of 180° relative to each other. The above-described arrangement of the recessed portions and protrusions need to be realized only when the half parts are combined together, and therefore, the recessed portions 15, 16 and the protrusions 10 can be provided near the center of each half part. Note that, however, formation of a bobbin with protrusions is easy when the protrusions 10 are positioned at the terminal ends of the half part as in the embodiment shown in FIG. 1 to FIG. 6.

Figure 7:
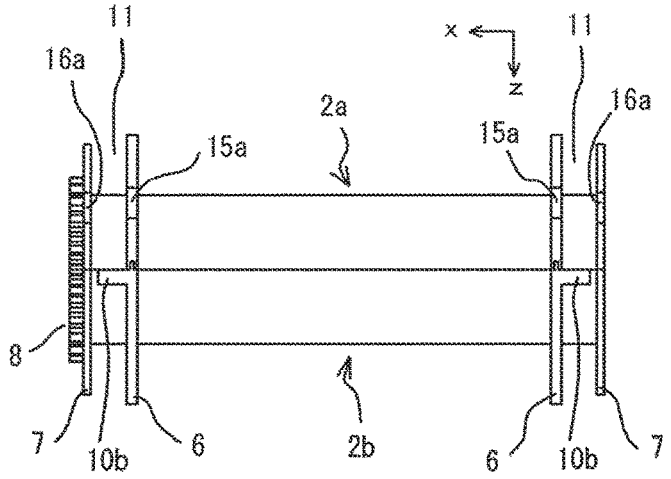
FIG. 7 is a diagram showing another example of the bobbin for use in an embodiment of the core case unit of the present invention.

In the embodiment shown in FIG. 1 to FIG. 6, the gear portions 8 are provided on the outer side of the outer flanges 7 at opposite ends of the cylindrical portion 5. However, rotation is possible so long as the gear portion 8 is provided on the outer side of at least one of the outer flanges 7. Therefore, the size of the bobbin can be reduced by not providing a gear portion on the outer side of one of the outer flanges 7 as shown in FIG. 7. Note that, however, from the viewpoint of stably rotating the bobbin by means of driving at both ends, it is preferred that the gear portion 8 is provided on each of the outer sides of the outer flanges 7 at opposite ends of the cylindrical portion.

Although the material of the bobbin 2 is not particularly limited, a resin such as PET, PBT, and PPS, for example, can be used as in the case 1.

(Coil Part)

Figure 12:
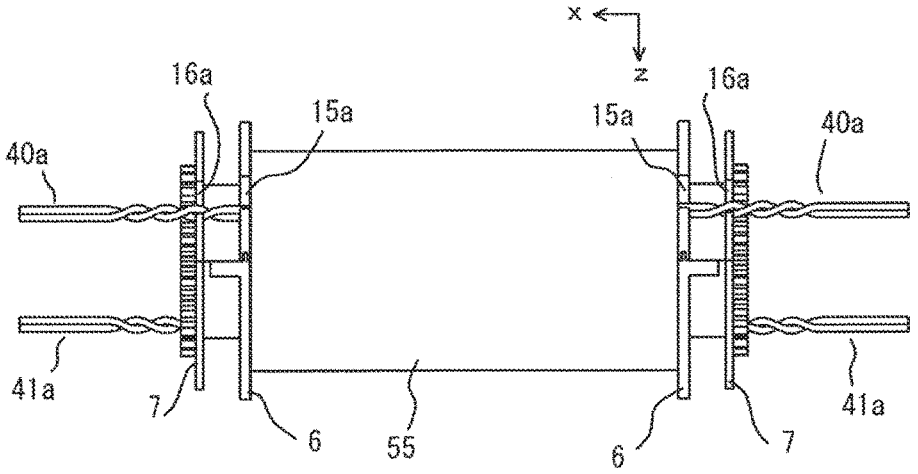
FIG. 12 is a diagram for illustrating a step which follows the step of winding a wire around a bobbin in a coil part manufacturing method according to an embodiment of the present invention.
Figure 13:
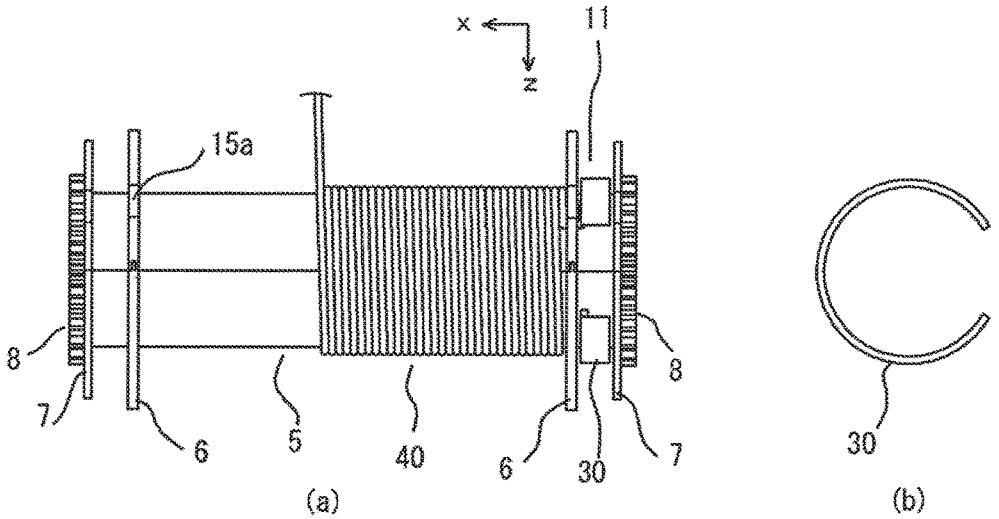
FIGS. 13(*a*) and 13(*b*) are diagrams showing a configuration of a cover which is applicable to a coil part manufacturing method according to an embodiment of the present invention.
Figure 14:
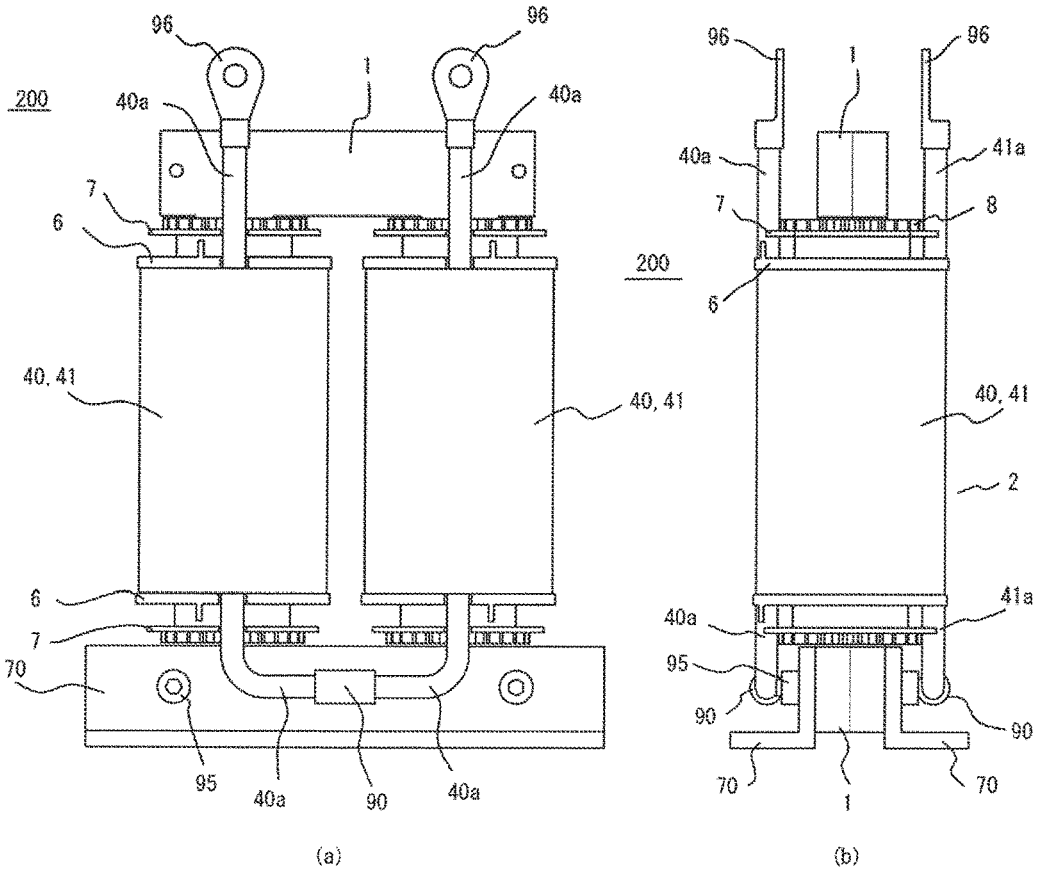
FIGS. 14(*a*) and 14(*b*) are diagrams showing an embodiment of a coil part of the present invention.
Figure 15:
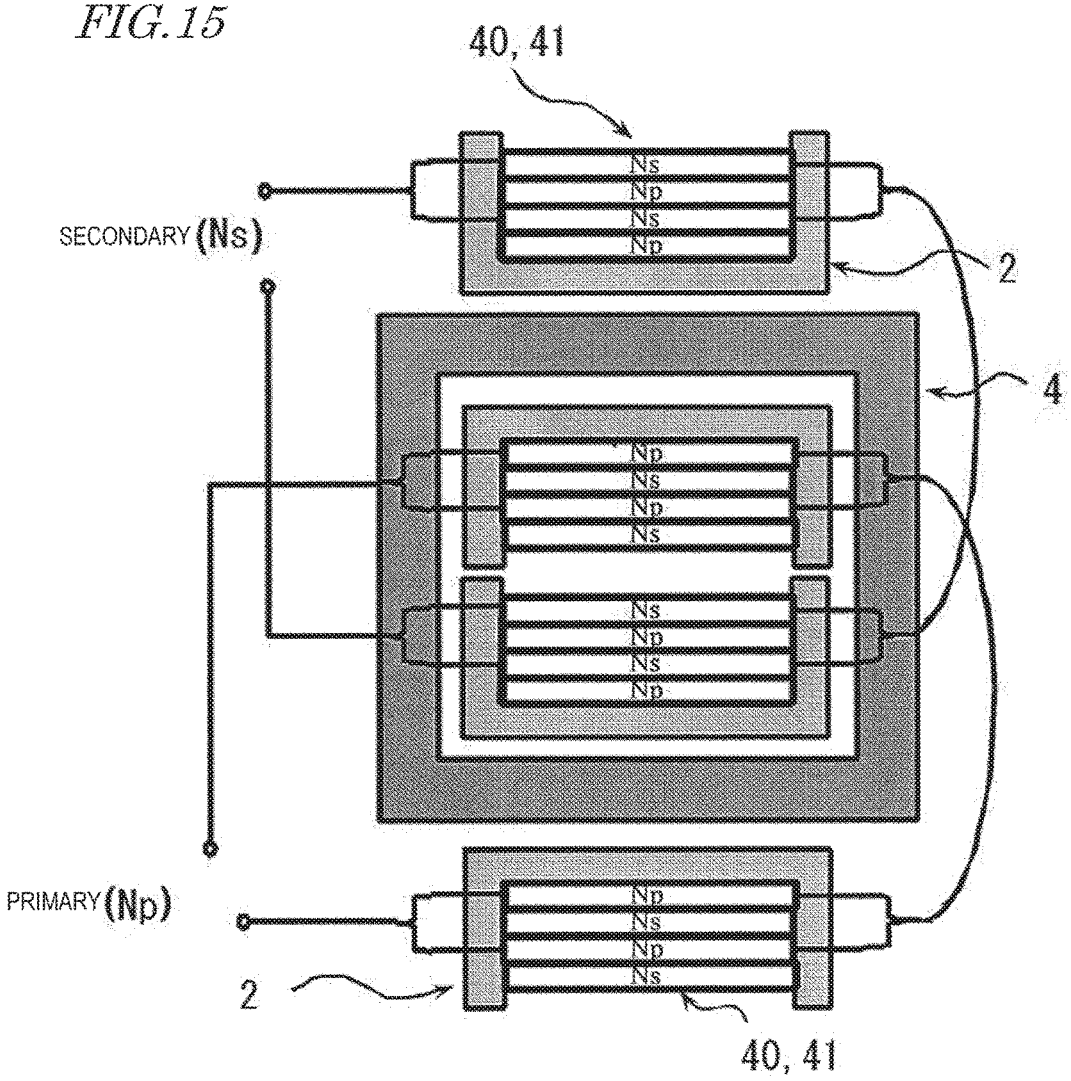
FIG. 15 is a cross-sectional view showing another embodiment of the coil part of the present invention.

A coil part which includes the above-described core case unit and a manufacturing method of the coil part are described with further reference to FIG. 8 to FIG. 15. FIG. 14(*a*) is a front view of the coil part. FIG. 14(*b*) is a side view of the coil part. The above-described core case unit has a configuration suitable to a case where gear winding is applied to a transformer. Therefore, in the following description, it is assumed that the coil part is a transformer. However, the coil part is not limited to the transformer. The coil part may be a choke coil or the like. A coil part 200 of an embodiment shown in FIGS. 14(*a*) and 14(*b*) includes a core case unit which includes the case 1 and the bobbin 2 and a no-cut magnetic core of a closed magnetic path which is housed in the case 1. The core case unit and the magnetic core may have the same configurations as those of the core case unit 100 and the magnetic core 4 in the embodiment illustrated with reference to FIG. 1 to FIG. 3. The coil part 200 further includes a coil 40 and a coil 41 which are formed by winding wires around the bobbin 2. The coils 40, 41 are arranged in multiple layers between the inner flanges 6 that are provided at opposite ends of the cylindrical portion 5.

The coil part 200 shown in FIGS. 14(*a*) and 14(*b*) includes coils 40, 41 which are provided at each of two bobbins. As shown in the schematic cross-sectional view of FIG. 15, at each bobbin, a plurality of coils 40 are connected in parallel, which are referred to as primary sub-coils, and a plurality of coils 41 are connected in parallel, which are referred to as secondary sub-coils. The primary sub-coils are connected together in series, whereby a primary coil Np is formed, and the secondary sub-coils are connected together in series, whereby a secondary coil Ns is formed.

The wire that forms the primary coil Np and the wire that forms the secondary coil Ns can be, for example, an electric wire with an insulating coating, such as a three-layer insulated electric wire, which has a wire diameter of not less than φ1 mm. The insulating coating secures insulation between the primary coil Np and the secondary coil Ns. Note that, however, securing insulation between the primary coil Np and the secondary coil Ns by means of the insulating coating over every wire leads to increase in volume of the entire wound portions due to the thickness of the insulating coating itself. In view of such, a common magnet wire (enameled wire) is used, and an insulator sheet is provided between the coil that forms the primary coil and the coil that forms the secondary coil. When the insulator sheet used has flexibility, strength and dielectric strength so as to be windable around the bobbin 2, winding of the insulator sheet is also possible with utilization of rotation of the above-described gear portion 8. The material of the insulator sheet is preferably, for example, polyester, nonwoven insulating paper Nomex (registered trademark of Du Pont), or the like. As to the thickness, in consideration of insulation and flexibility, the insulator sheet used is desirably a polyester sheet having a thickness of 25 μm to 50 μm or a Nomex sheet having a thickness of 50 μm to 200 μm. In the illustrated example, the outermost surface of the coils 40, 41 is shown as being wrapped with the insulator sheet.

The end portions 40*a* of the primary coils Np and the end portions 41*a* of the secondary coils Ns are inserted in cylindrical resin members for insulation. One ends of the end portions 40*a* of the primary coils Np are connected together via a compression connector 90, while the other ends are connected by compression with ring terminals 96, whereby the primary coil Np is completed. Likewise, one ends of the end portions 41*a* of the secondary coils are connected together via a compression connector 90, while the other ends are connected by compression with ring terminals 96, whereby the secondary coil Ns is completed. Further, an intermediary member 70 for mounting is connected at the compression connector 90 side of the case 1, whereby the coil part 200 is formed. The intermediary member 70 is fixed by bolts 95 inserted through holes provided in a leg part bridging the linear portions 3 of the case 1. The intermediary member 70 has a through hole for mounting and enables upright mounting on a mounting surface to which the coil part 200 is secured. When the coil part 200 is mounted upright, the air in a space between the external surface of the case 1 and the internal surface of the bobbin 2 is warmed by heat radiated from the coils, and a flow of air occurs in that space due to the stack effect so that release of heat can be enhanced.

The no-cut magnetic core 4 may be a wound magnetic core which is formed by winding a magnetic alloy ribbon into an annular arrangement, or a multilayer magnetic core which is formed by layering a plurality of magnetic alloy ribbons cut into a predetermined shape. The magnetic core 4 shown in FIG. 2 is a rectangular annular magnetic core which forms a magnetic path in an oblong quadrangular shape, although the shape of the magnetic core is not limited to this example. Note that, however, since the magnetic core 4 is housed in the case 1 that has linear portions 3, the magnetic core used has a shape which partially includes a linear portion. For example, a magnetic core which has a rectangular annular shape ("□" shape), a racetrack shape, a rectangular annular shape with a middle leg ("目" shape), or the like, can be used. In the case of a simple annular magnetic core, such as rectangular annular ("口" shape) and racetrack magnetic cores, a wound magnetic core configuration is particularly preferred from the viewpoint of productivity. Magnetic cores which have a rectangular annular shape with a middle leg ("目" shape) can be formed by layering magnetic alloy ribbons cut into such a shape or by surrounding two wound magnetic cores placed side-by-side with another wound magnetic core. Note that, the term "rectangular" used herein for representing the shape of the magnetic core is not limited to a perfect rectangular shape but intends to include a shape that has rounded portions at the corners which are entailed by winding of the magnetic alloy ribbon.

As described above, the magnetic core 4 can be formed by winding or layering a magnetic alloy ribbon. The magnetic alloy ribbon is, for example, a Fe-based amorphous alloy ribbon, a Co-based amorphous alloy ribbon, or a Fe-based nanocrystalline alloy ribbon, which are obtained by rapid cooling of a molten metal. Since even the Co-based amorphous alloy ribbon, which has relatively low saturation magnetic flux density, has a saturation magnetic flux density of not less than about 0.55 T, these magnetic alloy ribbons have higher saturation magnetic flux densities than ferrites and are advantageous in size reduction of the transformer. To exploit the advantage to the fullest extent, the magnetic core 5 is formed as a no-cut core.

The composition and characteristics of the magnetic alloy ribbon used for forming the magnetic core 4 are not particularly limited. In the case of a use for, for example, a transformer for use in an insulated switched mode power supply or the like, the magnetic alloy ribbon used preferably has such magnetic characteristics that the saturation magnetic flux density Bs is not less than 1.0 T, and the ratio of the residual magnetic flux density Br to the saturation magnetic flux density Bs, Br/Bs, is not more than 0.3. Specifically, a material whose Br is decreased by causing anisotropy in a direction perpendicular to the magnetic path by means of a heat treatment in a magnetic field is preferred. By causing anisotropy in a direction perpendicular to the magnetic path by means of a heat treatment in a magnetic field, the ratio of the residual magnetic flux density Br to the saturation magnetic flux density Bs, Br/Bs, can be decreased.

Next, a preferred embodiment of the coil part is described, together with a manufacturing method, with reference to FIG. 8 to FIG. 13. Specific descriptions and illustrations of portions overlapping the previous description of the coil part are properly omitted. A manufacturing method of a coil part according to an embodiment of the present invention includes the first step of housing a no-cut magnetic core of a closed magnetic path in a case which includes a linear portion extending along a magnetic path of the magnetic core, the second step of attaching a bobbin to the linear portion of the case, the bobbin including a cylindrical portion around which a wire is to be wound, inner flanges provided at opposite ends of the cylindrical portion, and outer flanges provided on an outer side of the inner flanges, and the third step of winding a wire around the cylindrical portion, thereby forming a coil. The bobbin is rotatably supported on the linear portion of the case at the cylindrical portion and further includes a gear portion provided on an outer side of at least one of the outer flanges for receiving rotational force. The outside diameter of the outer flanges is greater than the outermost diameter of the gear portion. In the third step, the bobbin is rotated via the gear portion, whereby the wire is wound around the cylindrical portion to form a coil, and a subsequent wire winding operation is performed while a winding end of the wire is placed between the inner flange and the outer flange.

Specifically, firstly, one end of a wire (winding end) is placed between an inner flange and an outer flange on one side, and then, the wire is wound around the cylindrical portion to form a coil. The finishing end of the coil (winding end) is placed between an inner flange and an outer flange on the other side. In such a state, a subsequent wire winding operation is performed in the same way. After the winding operations for all wires have been finished, a connection process for the winding ends is performed, whereby formation of the coils is completed.

Figure 8:
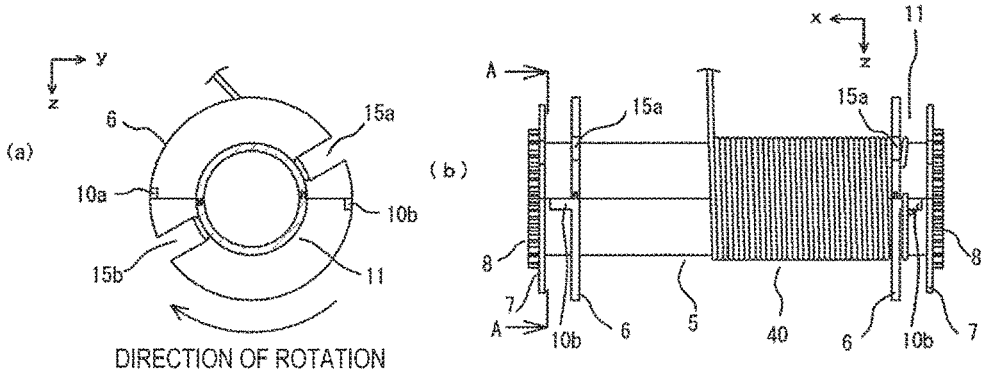
FIGS. 8(*a*) and 8(*b*) are diagrams for illustrating the step of winding a wire around a bobbin in a coil part manufacturing method according to an embodiment of the present invention.
Figure 9:
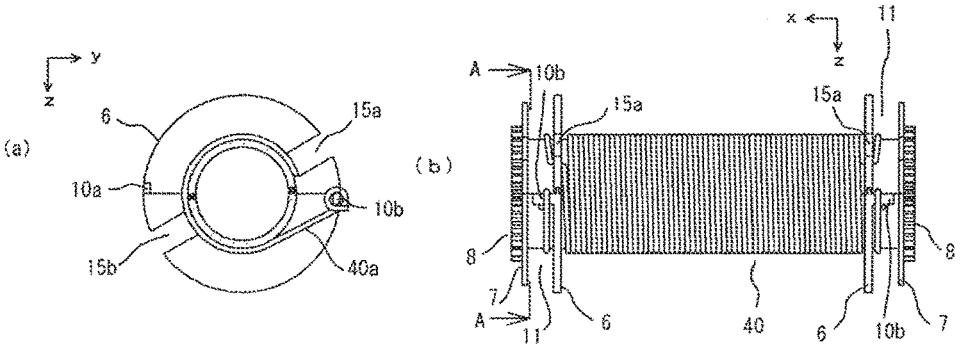
FIGS. 9(*a*) and 9(*b*) are diagrams for illustrating the step of winding a wire around a bobbin in a coil part manufacturing method according to an embodiment of the present invention.

The third step is further described. FIG. 8(*a*) is a cross-sectional view taken along line A-A, showing an end of the bobbin at the finishing side of winding in the wire winding operation for a coil part. FIG. 8(*b*) shows a state the middle of the wire winding operation. In FIG. 8(*b*), an end portion of the wire (wire end portion) is passed through a recessed portion 15*a* of an inner flange 6 at the starting side of winding in the x direction and placed in the space 11. In the space 11, the wire end portion is wound in a direction opposite to the rotation of the bobbin so as to form a single turn and engaged with a protrusion 10*b* of the inner flange 6. The gear portion 8 is rotated to wind a wire such that a predetermined number of turns are made at the finishing side of winding of the cylindrical portion 5, and an end of the wire is cut off at a predetermined length. FIG. 9(*b*) shows a state after the wire winding operation. FIG. 9(*a*) is a cross-sectional view taken along line A-A, showing an end of the bobbin at the finishing side of winding. A wire end portion of the coil 40 at the finishing side of winding is also wound in a direction opposite to the rotation of the bobbin so as to form a single turn and engaged with a protrusion 10*b* of the inner flange 6.

Figure 10:
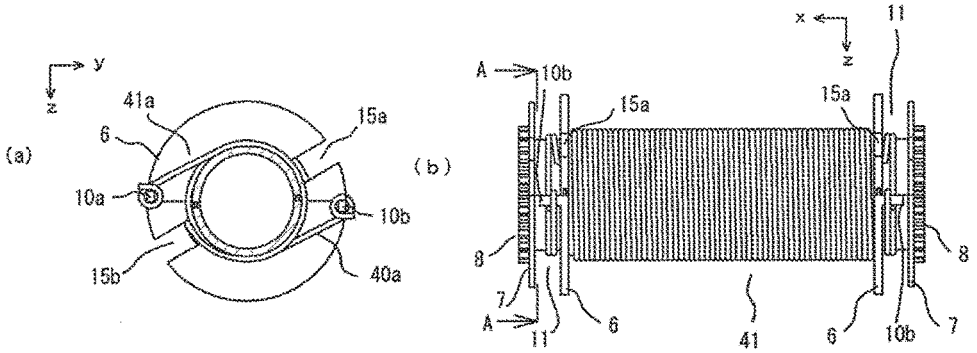
FIGS. 10(*a*) and 10(*b*) are diagrams for illustrating the step of winding a wire around a bobbin in a coil part manufacturing method according to an embodiment of the present invention.

Next, a coil 41 is formed over the coil 40. FIG. 10(*b*) shows a state after the wires have been wound in two layers. FIG. 10(*a*) is a cross-sectional view taken along line A-A, showing an end of the bobbin at the finishing side of winding. A wire end portion of the coil 41 at the starting side of winding is passed through a recessed portion 15*b* (not shown) of an inner flange 6 at the starting side of winding in the x direction and placed in the space 11. In the space 11, the wire end portion is wound in a direction opposite to the rotation of the bobbin so as to form a single turn and engaged with a protrusion 10*a* (not shown) of the inner flange 6. The other wire end portion of the coil 41 at the finishing side of winding is also wound in a direction opposite to the rotation of the bobbin so as to form a single turn and engaged with a protrusion 10*a* of the inner flange 6. In the third step, formation of the coil 40 and formation of the coil 41 are sequentially performed multiple times such that multiple layers are formed. Insulator sheets 55 are provided between coil layers and over the coil 41 of the outermost layer which constitutes the lateral surface, although description of the method for forming the insulator sheets 55 is omitted.

Since winding of a wire is realized by rotation of the gear portion, the wire winding operation is easy even when a no-cut magnetic core is used. Further, since an outer flange which has a greater outside diameter than the outermost diameter of the gear portion is provided between the inner flange and the gear portion, the wire winding operation can be performed while a winding end is contained in the space between the inner flange and the outer flange such that the wire end portion does not deviate to the gear portion side or somewhere else. This configuration is suitable to a case where a primary coil Np and a secondary coil Ns which are constituents of a transformer are wound around. Wound portions of the wire that forms the primary coil Np and wound portions of the wire that forms the secondary coil Ns can be formed alternately with high accuracy in a radial direction of the cylindrical portion.

Preferred forms, such as a configuration where each of the primary coil Np and the secondary coil Ns are divided into a plurality of wound portions which are connected in parallel or in series, a configuration featuring recesses in the flanges, and a configuration featuring protrusions protruding from the surface of the flanges, are as described above. Among these configurations, the configuration featuring protrusions is further described below.

Figure 11:
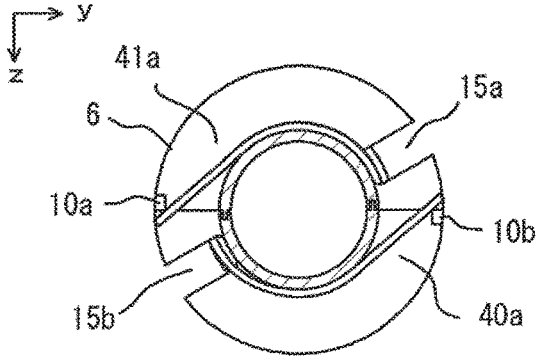
FIG. 11 is a diagram for illustrating how to process a wire end portion in the step of winding a wire around a bobbin in a coil part manufacturing method according to an embodiment of the present invention.

The wire end portion can be held within the space between the inner flange and the outer flange only by winding the wire end portion in the space. For example, the wire end portion is wound to form one or more turns, or the wire end portion is wound so as to underpass the inner side of the protrusions 10*a*, 10*b* with the terminal end of the wire end portion being placed on the inside diameter side of the protrusions 10*a*, 10*b* as shown in FIG. 11, whereby the wire end portion can be held within the space. In the illustrated example, the respective wire end portions of the coils 40, 41 pulled out through the recessed portions 15*a*, 15*b* of the inner flange 6 are each wound about half around in the space 11. The wire end portion of the coil 40 is supportedly held by the protrusion 10*b*, and the wire end portion of the coil 41 is supportedly held by the protrusion 10*a*.

To increase the certainty, it is preferred that, as shown in FIG. 10 and relevant drawings, in the third step, a protrusion protruding from the surface of the inner flange is used, and the winding end of each wound portion is engaged with the protrusion. When the winding end of each wound portion is temporarily engaged with the protrusion, and after formation of all of the wound portions is finished, processes such as connection of the winding ends are performed, the winding ends wound not be unbound, and the wire winding operation becomes easy.

Further, when the inner flanges 6 and the outer flanges 7 have the recessed portions 15, 16, after the third step, the winding ends of the wires can be guided out to the outside of the outer flanges 7 through the recessed portions 15, 16 of the inner flanges 6 and the outer flanges 7 as shown in FIG. 12.

The wire end portions at the starting side and finishing side of winding of the coil, which are contained in the spaces 11 between the inner flanges 6 and the outer flanges 7, do not have an insulation cover for the end portions 40*a*, 41*a*. The coil 40 is pulled out from the cylindrical portion of the bobbin through the recessed portions 15*a*, 16*a*, while the coil 41 is pulled out through the recessed portions 15*b*, 16*b* (not shown). When viewed in an axial direction of the cylindrical portion 5, the recessed portions 15 of the inner flanges 6 and the recessed portions 16 of the outer flanges 7 overlap, and the wire end portions are linearly guided out from the inner flanges 6 to the outer flanges 7. The wire end portions of a plurality of coils 40 are twisted so as to connect the plurality of coils 40 in parallel, whereby a primary sub-coil is obtained. Likewise, the wire end portions of a plurality of coils 41 are twisted so as to connect the plurality of coils 41 in parallel, whereby a secondary sub-coil is obtained. Each sub-coil is connected in series with a sub-coil provided in the other bobbin, whereby a coil part shown in FIG. 14 is obtained.

As shown in FIG. 13, the space in which the winding end is contained is covered with a cover 30, whereby the winding end can be more assuredly confined. The cover shown in FIG. 13 has a width smaller than the gap between the inner flange 6 and the outer flange 7. The lateral surface shape of the cover is a generally "C" shape. When the cover is made of an elastic material, such as plastic, plate spring, or the like, the operation of attaching and detaching the cover is easy. Although the cover 30 shown in FIG. 13 has a generally "C" shape, the form of the cover is not limited to this example. It is only necessary that the lateral surface shape of the cover 30 covering the periphery of the space in which the winding end is contained is generally circular. For example, a cover which is closed such that the tip ends of the cover overlap is also applicable.

Figure 16:
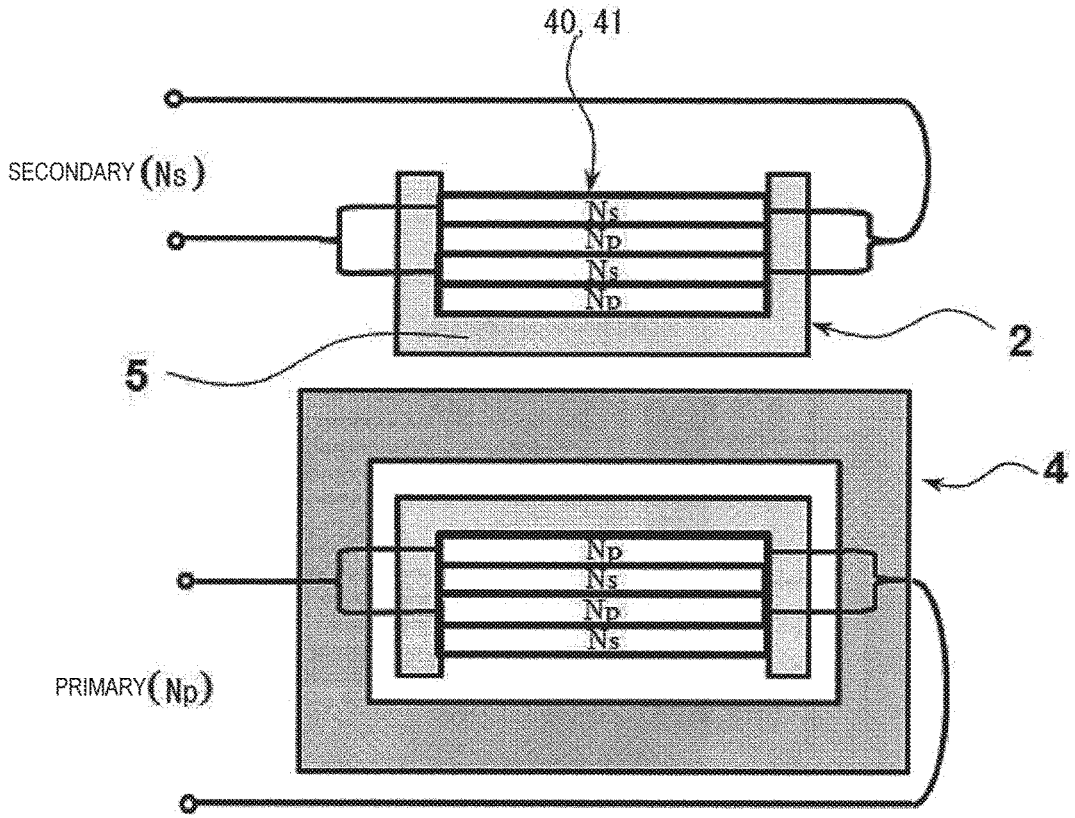
FIG. 16 is a cross-sectional view showing still another embodiment of the coil part of the present invention.

Next, another configuration example of the coil which is applied to the embodiment of the coil part is described. FIG. 16 is a schematic cross-sectional view showing an embodiment of a coil part including a primary coil and a secondary coil which are constituents of a transformer. For the sake of convenience, a case which houses a magnetic core 4 is not shown. Wound portions of a wire which forms the primary coil Np and wound portions of a wire which forms the secondary coil Ns are arranged alternately in a radial direction of the cylindrical portion 5 of the bobbin 2. The wound portions of the primary coil Np and the wound portions of the secondary coil Ns are provided at the same portions of the magnetic core 4 such that coils are formed with the wire of the primary coil and the wire of the secondary coil being in close contact with each other, and therefore, coupling between the coils is improved. Realizing a transformer of a high coupling coefficient can suppress increase of the effective resistance (AC resistance). That is, according to a configuration where the wound portions of the primary coil and the wound portions of the secondary coil are arranged alternately in a radial direction of the cylindrical portion, the effect of suppressing increase of the copper loss is obtained. Together with the effect of reducing the gap loss which is achieved by the use of the above-described uncut magnetic core, this configuration contributes to loss reduction and size reduction in the transformer.

In the wound portions, the wire is wound around the cylindrical portion 5 from one end to the other end of the cylindrical portion 5 (x direction). Although in the wound portions the wire can be wound in a radially-layered arrangement so as to form coils, it is preferred from the purpose of improving the above-described coupling between the coils that each wound portion has a single layer arrangement, without layering of the wire in each coil.

As a configuration of alternately arranging the wound portions in a radial direction of the cylindrical portion 5, arranging the wound portions of the respective coils in layers in a one-by-one manner so as to form the primary coil Np and the secondary coil Ns is possible. However, it is preferred that, as in the embodiment shown in FIG. 15, the primary coil Np and the secondary coil Ns are each divided into a plurality of wound portions which are connected in parallel, and the plurality of wound portions are arranged alternately in layers in a radial direction of the cylindrical portion in each of the primary coil and the secondary coil. Such a configuration reduces the resistance of the coils and improves the coupling of the primary coil Np and the secondary coil Ns. The form of connection of the divided coils is not limited to parallel connection, but serial connection is applicable. Dividing and alternately arranging the wires as described above is more advantageous in terms of the coupling between the coils than winding the wires into a layered arrangement.

Figure 17:
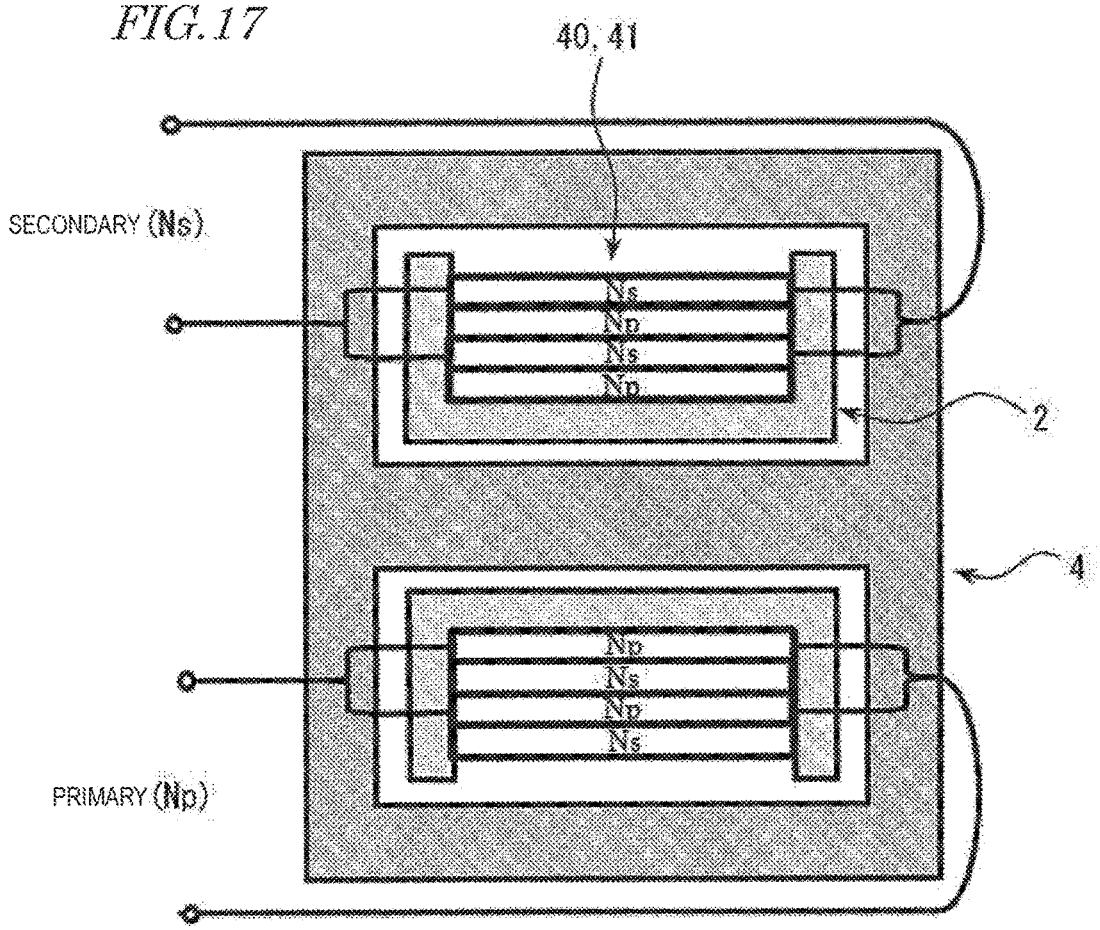
FIG. 17 is a cross-sectional view showing still another embodiment of the coil part of the present invention.
Figure 18:
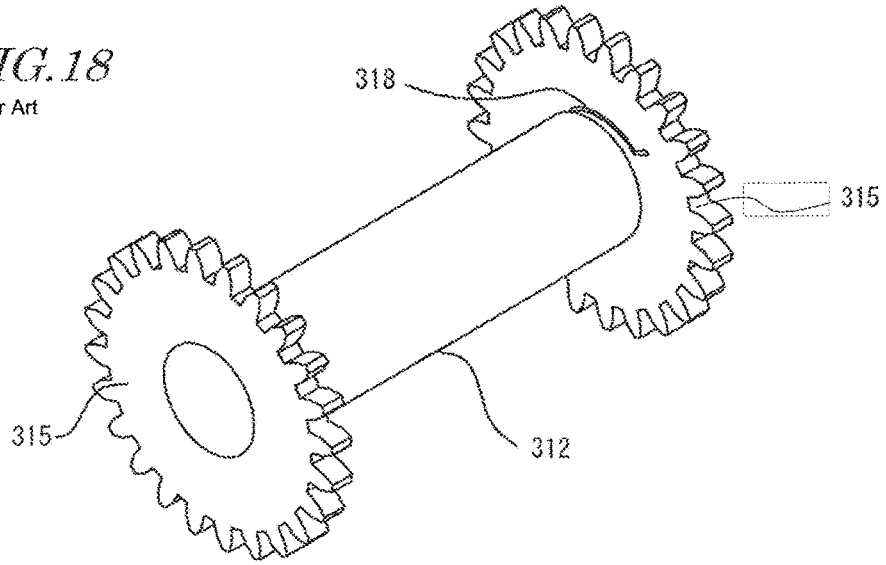
FIG.18 Prior Art
FIG. 18 is a diagram showing a conventional bobbin structure.
Figure 19:
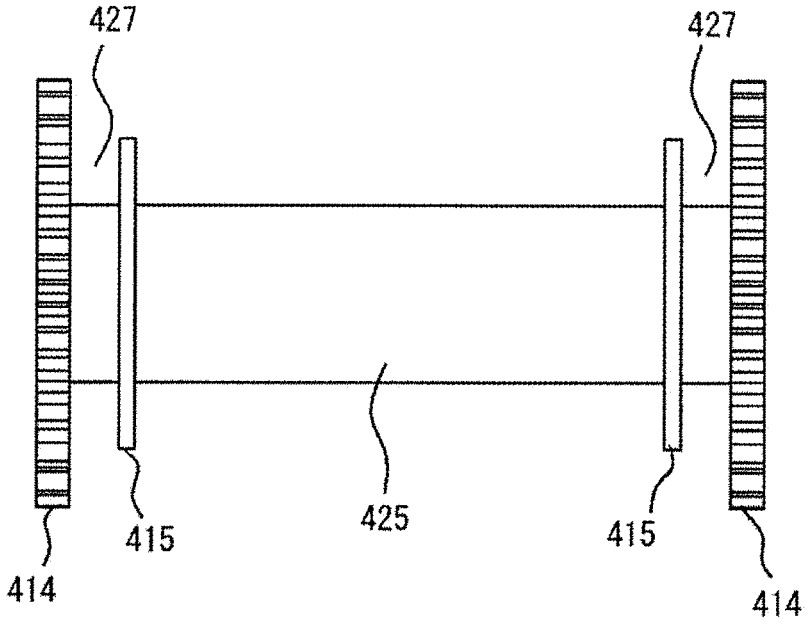
FIG. 19 Prior Art
FIG. 19 is a diagram showing another conventional bobbin structure.

The above-described coil configuration is also applicable to a transformer which uses a magnetic core which has a rectangular annular shape with a middle leg ("日" shape). FIG. 17 is a schematic cross-sectional view showing an embodiment of such a transformer. The present embodiment is different from the other embodiments in that the bobbin 2 which has the primary coil Np and the secondary coil Ns is provided at the middle leg of the magnetic core 4. However, the configurations of the coils and the bobbin are the same as those of the other embodiments, and descriptions thereof are herein omitted.

The configuration where each of the primary coil and the secondary coil are divided into a plurality of wound portions which are connected in parallel or in series is not limited to the above-described embodiments. The primary coil and the secondary coil only need to include divided portions which are connected in parallel or in series. As the form of the connection, the parallel connection or the serial connection is solely applicable. Alternatively, a combination of the parallel connection and the serial connection is also applicable.

A coil part according to an embodiment of the present invention can effectively exploit the characteristics of a magnetic alloy ribbon which has high magnetic flux density while securing the manipulation convenience in a wire winding operation, and is thus applicable to various power supply devices, particularly to transformers for use in power supply devices, such as a switched mode power supply whose output exceeds 1 kW, an insulated inverter, and the like.

REFERENCE SIGNS LIST

1 case
2 bobbin
3 linear portion
4 magnetic core
5 cylindrical portion
6 inner flange
7 outer flange
8 gear portion
10 protrusion
15, 16 recessed portion
30 cover
100 core case unit
200 coil part

The invention claimed is:

1. A core case unit, comprising:

an annular case which houses a no-cut magnetic core; and a bobbin around which a wire is to be wound, wherein the bobbin includes a cylindrical portion around which the wire is to be wound, inner flanges provided at opposite ends of the cylindrical portion, outer flanges provided on an outer side of the inner flanges with a space being left between the outer flanges and the inner flanges which is capable of containing a wire end portion, and a gear portion provided on an outer side of at least one of the outer flanges for receiving rotational force, the bobbin being rotatably supported on the case at the cylindrical portion, an outside diameter of the outer flanges is greater than an outside diameter of the gear portion which is defined by an addendum circle, and the inner flanges and the outer flanges have a recessed portion through which a wire end portion is to be passed.

2. The core case unit of claim 1, wherein when viewed in an axial direction of the cylindrical portion, the recessed portion of the inner flange and the recessed portion of the outer flange at least partially overlap.

3. The core case unit of claim 1, wherein the inner flange and the outer flange each have a pair of recessed portions, and when viewed in an axial direction of the cylindrical portion, the pair of recessed portions of the inner flange are at positions of rotational symmetry of 180°, and the pair of recessed portions of the outer flange are also at positions of rotational symmetry of 180°.

4. The core case unit of claim 1, wherein the space is a groove running around the cylindrical portion in a circumferential direction of the cylindrical portion.

5. The core case unit of claim 4, wherein a distance in a radial direction from a center of the cylindrical portion to a bottom surface of the groove is substantially equal to a distance in the radial direction from the center of the cylindrical portion to a lateral surface of the cylindrical portion.

6. The core case unit of claim 1, wherein a protrusion is provided for supportedly holding the wire end portion, the protrusion protruding outward in an axial direction of the cylindrical portion from a surface of the inner flange.

7. The core case unit of claim 6, wherein an outside diameter of the inner flange is greater than an outside diameter of the outer flange, and a protruding position of the protrusion is outside an outer perimeter of the outer flange when viewed in an axial direction of the cylindrical portion.

8. The core case unit of claim 6, wherein when viewed in an axial direction of the cylindrical portion, the protrusions are at positions of rotational symmetry of 180°.

9. The core case unit of claim 1, wherein a bottom of a recessed portion of the inner flange is substantially equally distant from a lateral surface of the cylindrical portion and from a center axis of the cylindrical portion, and a bottom of a recessed portion of the outer flange is substantially equally distant from a circumferential surface of an addendum circle of the gear portion and from the center axis of the cylindrical portion.

10. A coil part, comprising:

the core case unit as set forth in claim 1;

a no-cut magnetic core of a closed magnetic path housed in the case; and a coil formed by winding a wire around the bobbin, wherein the coil is provided between inner flanges that are provided at opposite ends of the cylindrical portion.

11. A coil part, comprising:

the core case unit as set forth in claim 1;

a no-cut magnetic core of a closed magnetic path housed in the case; and a coil formed by winding a wire around the bobbin, wherein the coil is provided between inner flanges that are provided at opposite ends of the cylindrical portion, and a wire end portion of the wire that forms the coil is guided out to an outside of an outer flange through the recessed portion of the inner flange and a recessed portion of the outer flange.

12. The coil part of claim 10, wherein the coil includes a primary coil and a secondary coil which are constituents of a transformer, and a wound portion of a wire that forms the primary coil and a wound portion of a wire that forms the secondary coil are arranged alternately in multiple layers in a radial direction of the cylindrical portion.

13. The coil part of claim 12, wherein each of the inner flange and the outer flange has two recessed portions, and a wire end portion of the wire that forms the primary coil is guided out through one of two recessed portions provided in each of the inner flange and the outer flange, and a wire end portion of the wire that forms the secondary coil is guided out through the other one of the two recessed portions provided in each of the inner flange and the outer flange.

* * * * *